United States Patent [19]

DeMusis

[11] 3,984,212

[45] Oct. 5, 1976

[54] TURBINE BLADE AIR SEAL, SIDE GRINDER

[76] Inventor: Ralph T. DeMusis, c/o Turbine Components Corp., 1 Commercial St., Branford, Conn., 06405

[22] Filed: May 5, 1975

[21] Appl. No.: 574,563

[52] U.S. Cl. ..... 51/140; 51/141

[51] Int. Cl.[2] ..... B24B 21/06; B24B 21/16

[58] Field of Search ..... 51/135 R, 140, 141, 51/143, 82 R, 128, 99

[56] References Cited

UNITED STATES PATENTS

| | | | |
|---|---|---|---|
| 572,812 | 12/1896 | Longen | 51/140 |
| 677,589 | 7/1901 | Nichols | 51/99 X |
| 908,977 | 1/1909 | Dickson | 51/140 |
| 1,178,400 | 4/1916 | Jones | 51/82 R |
| 1,415,785 | 5/1922 | Brown | 51/141 |
| 2,334,960 | 11/1943 | Roth et al. | 51/141 X |
| 2,728,364 | 12/1955 | Muehling | 51/128 X |

*Primary Examiner*—Al Lawrence Smith
*Assistant Examiner*—Nicholas P. Godici
*Attorney, Agent, or Firm*—H. Gibner Lehmann; K. Gibner Lehmann

[57] ABSTRACT

Disclosed is a machine for refinishing the side surfaces of air seal flanges which are located at the extremities of turbine blades and which have been resurfaced by welding. The machine comprises a pair of cutting belts arranged to have portions of their cutting surfaces juxtaposed and facing each other at a work-performing station, on a bench or table. The belts are power driven, and at the work-performing station pass between a pair of pivotally mounted pressure shoes which can be actuated by the machine operator to press against the back surfaces of the belts, so as to bring the belt cutting surfaces closer together. On the machine bench there is a movable slide, to which a turbine blade can be clamped in a manner to advance and place the built-up air seal flange thereof between the spaced-apart cutting belts at the work-performing station. A guide on the machine bench facilitates the positioning of the turbine blade seal between the belts. The pressure shoes are pivotally actuated by handles which are manipulated by the machine operator in a manner that the shoes can apply pressure to, and laterally shift the cutting belts against the opposite sides of the built-up air seal. This removes the excess metal from both sides of the seal simultaneously. Adjustable stops on the bench limit the extent of pivoting movement of the pressure shoes, and thus determine the amount of material which must be removed from the side surfaces of the seal flanges.

8 Claims, 5 Drawing Figures

TURBINE BLADE AIR SEAL, SIDE GRINDER

CROSS REFERENCES TO RELATED APPLICATIONS

Copending application of Ralph T. DeMusis entitled Turbine Blade Air Seal, Edge Grinder, filed May 5, 1975 under Ser. No. 574,564.

BACKGROUND

This invention relates to machines for refinishing the side surfaces of air seal flanges of turbine blades which have become worn and otherwise no longer useful. Heretofore, many turbine blades after having served an initial useful life, were discarded since they were considered as not recoverable or repairable. This represented a considerable expense, and was a wasteful process since the blades were cast of special alloy metal, and required complicated molds and costly finishing operations whereby their fabrication represented a high cost.

According to the present invention, blades having worn air seal flanges can be effectively repaired whereby their useful life is greatly extended, thus resulting in a considerable saving of money and time. The worn air seal flanges of the blades are builtup by adding metal, as with an electro-welding process, and thereafter the blades are placed in an apparatus which refinishes the built-up seal flanges at both side surfaces. This is accomplished by a machine comprising a bench or table having a flat top surface on which one or several pressure shoes are pivotally mounted at a work-performing station. One or several cutting belts having surfaces provided with cutting particles are mounted on pulleys so that the cutting surfaces pass (in the case of two belts) between two pressure shoes, in face-to-face, spaced relation to each other with the backs of the belts facing the shoes. The shoes are provided with handles by which they can be pivotally actuated to advance them against the backs of the belts so as to make the cutting surfaces of the belts approach each other. On the top of the bench a slide is provided, having clamping means adapted to accommodate a turbine blade in such a manner that the air seal flange thereof can be interposed between the spaced apart cutting belts at the work-performing station. Thereafter, when the pressure shoes are actuated to force the cutting surfaces of the belts against the opposite sides of the air seal flange, the excess metal is removed therefrom. Adjustable stop means are provided on the bench top, engageable with the pressure shoes to limit the pivoting movement thereof to that required for removing only the desired amount of excess metal. A guide adjustably secured to the bench top facilitates the correct positioning of the turbine blade so that the seal flange thereof can be readily interposed between the cutting surfaces of the belts.

A safety feature of the invention resides in the provision of the two handles, requiring the operator to use both hands in order to carry out the refinishing operation whereby there is minimized the likelihood of injury from contact with the cutting belts.

Each cutting belt is individually driven by its own motor, and passes over its own system of pulleys, thereby effecting a desirable simplicity of the machine and minimizing maintainance and servicing.

Other features and advantages will hereinafter appear. In the accompanying drawings.

Figure 1:
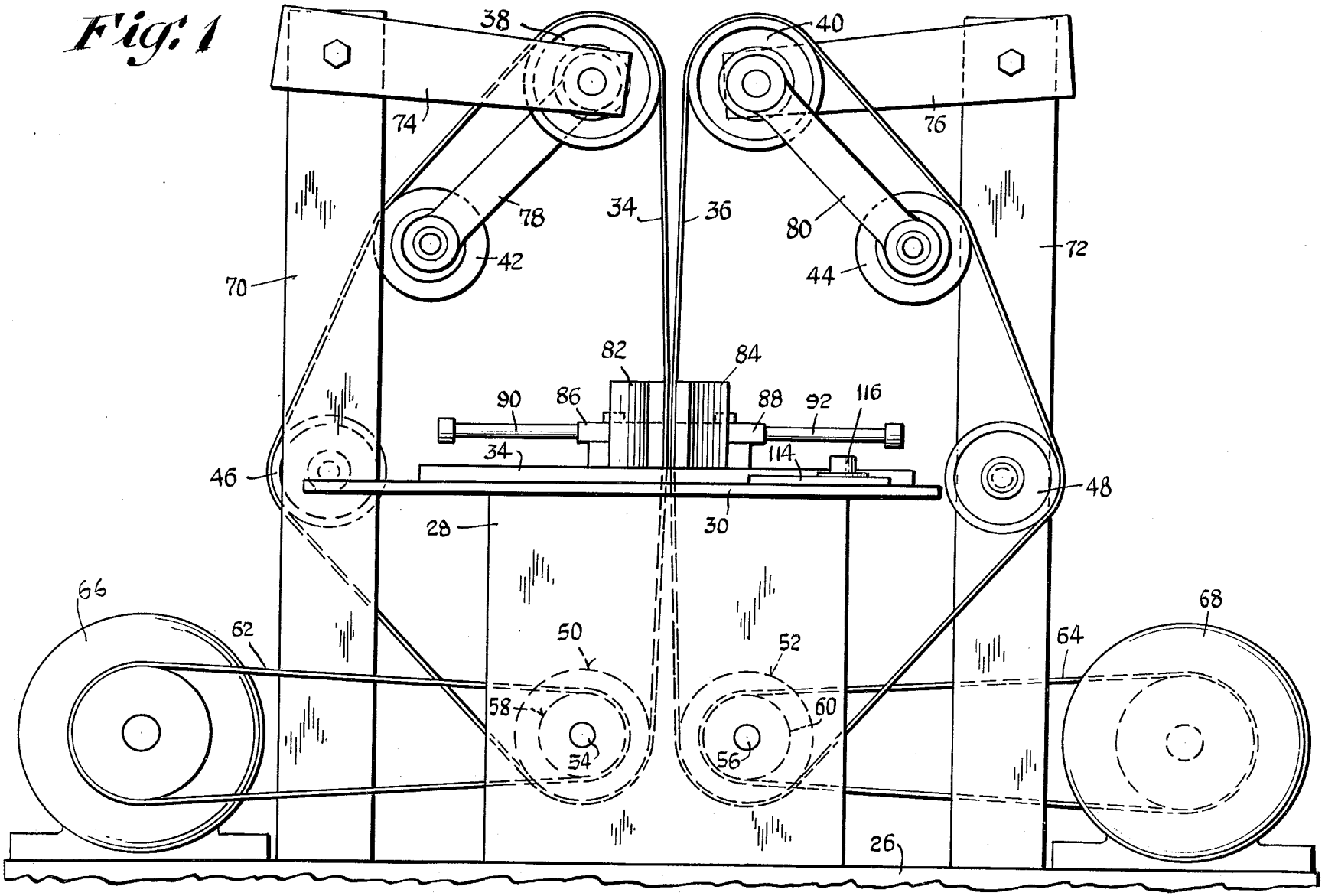
FIG. 1 is a front elevational view of the improved turbine blade air seal grinder as provided by the invention.

Considering first FIGS. 2–5 there is illustrated a usual type of turbine blade 10 comprising a curved elongated blade body 12 having at its outer end 14 an interlocking configuration of usual design, provided with air seal flanges 16, 18. At its other or inner end 20, the turbine blade 10 has a usual type of mounting base configuration 22 by which it is secured to the rotor of the turbine.

During the use and operation of the turbine engine, the air seal flanges 16, 18 become worn and lose their effectiveness. In the past, turbine blades having worn air seal flanges were discarded, and this was a wasteful practice inasmuch as the cost of fabrication of such blades was extremely high. Turbine blades of this type are fabricated of special metallic alloys formulated to withstand greatly elevated temperatures while at the same time maintaining their mechanical strength.

In accordance with the present invention it is no longer necessary to discard such turbine blades when the air seal flanges become worn. Instead, the invention proposes resurfacing or replenishing the sealing flanges, as by adding metal through an electric welding process. In this fashion the worn portions of the air seals can be replaced by metal of suitable alloy, having the necessary strength and resistance to high temperatures. After the addition of the metal by welding, the seal flanges are irregular and oversize, and require refinishing.

Figure 2:
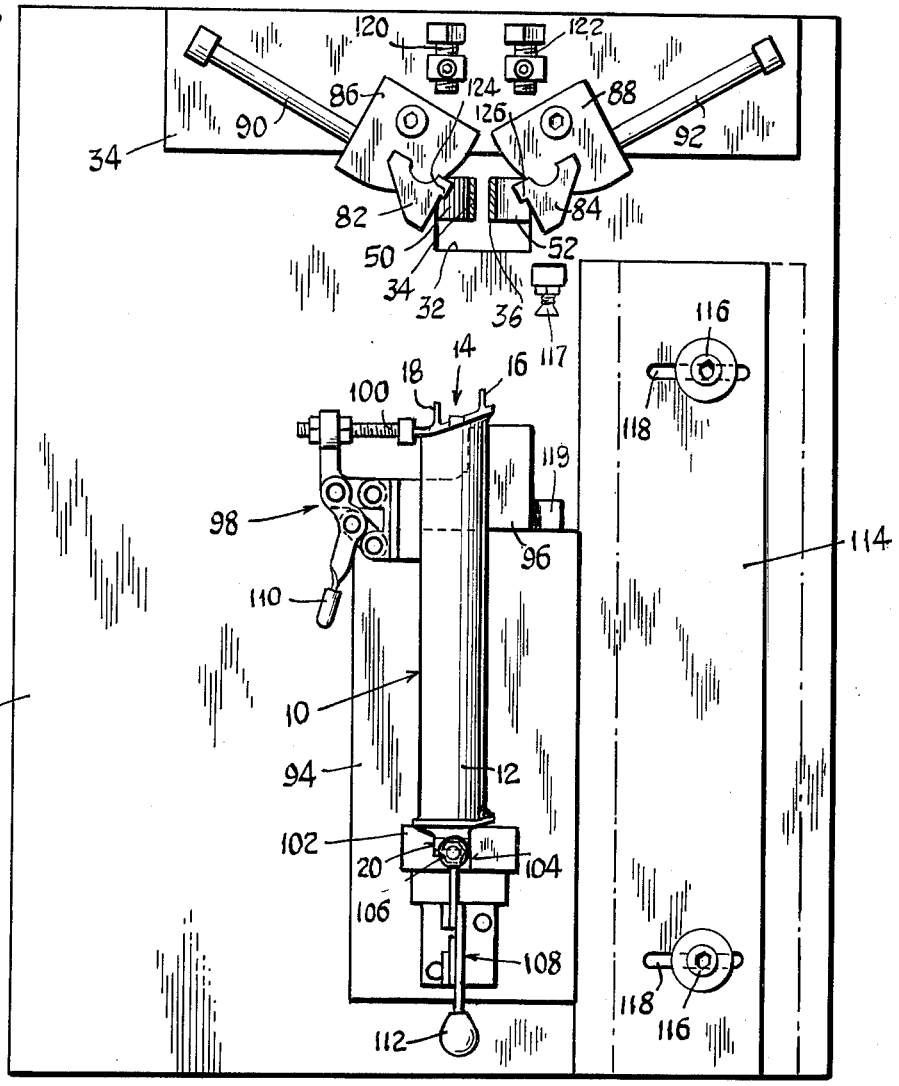
FIG. 2 is a top plan view of the bench top and associated components, of the machine of FIG. 1. The various parts are shown in the normally inoperative or non-finishing position.

The present invention accordingly provides a novel and unique machine which can quickly and accurately refinish the side surfaces of the built-up air seal flanges. Referring to FIG. 2, the turbine blade 10 is secured in position in the machine to refinish the air seal flange 16. The machine as illustrated comprises (FIGS. 1 and 2) a bench or table 26 formed of upstanding heavy metal plates 28 to which is secured a horizontal top plate 30. As seen in FIG. 2, the top plate 30 has a slot or well 32 at its rear, which is partially bridged by a bridge plate 34 secured in any suitable manner.

Passing through the remainder or open part of the well 32 are left and right cutting belts 34, 36 respectively constituted of any suitable construction such as fabric having cemented to one side surface emery or carborundum grits or the like. The belts 34, 36 respectively pass over left and right top pulleys 38, 40, left and right take-up idlers 42, 44, left and right idler pulleys 46, 48 and left and right bottom drive pulleys 50, 52. Between the widely spaced top pulleys 38, 40 and bottom pulleys 50, 52, the belts 34, 36 have a considerable expanse or length, and pass upward through the top plate 30 in the well 32 thereof. At the well or work-performing station 32 the belts are capable of being readily shifted laterally.

The left and right bottom pulleys 50, 52 are respectively carried on shafts 54, 56 which mount smaller-diameter drive pulleys 58, 60 engaged and driven by left and right belts 62, 64 from left and right drive motors 66, 68.

Secured to the bench 26 are left and right uprights 70, 72 constituted of channel members, said uprights mounting the idler pulleys 46, 48 and also at their upper extremities carrying left and right over-arms 74, 76 respectively, on which are mounted the top pulleys 38, 40. The over-arms 74, 76 also support spring biased tension arms 78, 30 at the extremities of which the left and right idler pulleys 42, 44 are carried. It will be understood that the tension arms 78, 80 and the idler pulleys 42, 44 maintain the required tension in the cutting belts 34, 36.

Figure 3:
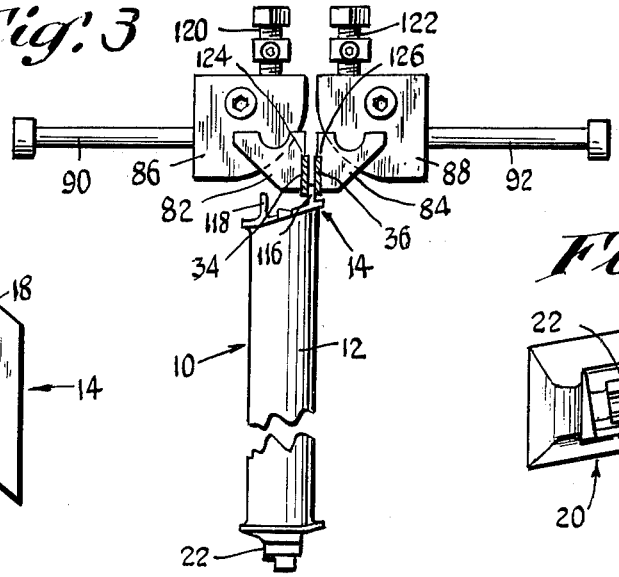
FIG. 3 is a fragmentary top plan view revealing the parts of the machine in their operative positions, refinishing the side surfaces of an air seal flange which has been resurfaced.
Figure 4:
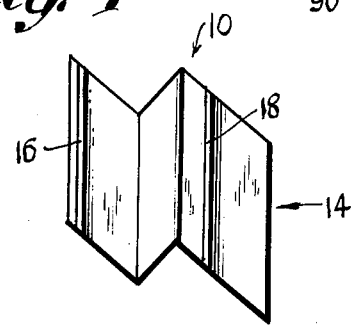
FIG. 4 is an end elevational view of a turbine blade of the type refinished in the machine of FIGS. 1–3. The elevation shown is of the outer end of the turbine blade.
Figure 5:
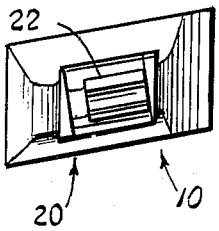
FIG. 5 is an end elevational view of the inner end of the trubine blade utilized in the machine.

Referring now to FIG. 2, the bridge plate 34 carries left and right pressure shoes 82, 84, these being secured to carrier blocks 86, 88 which are pivotally mounted on the bridge plate. Actuator handles 90, 92 secured to the carrier blocks 86, 88 enable the machine operator to swivel the blocks and also the pressure shoes 82, 84 carried thereby, in a manner to apply pressure to the backs or non-cutting surfaces of the belts 34, 36. As seen in FIG. 2, the pressure shoes 82, 84 are spaced from the belts and the handles 90, 92 are retracted or shifted rearward with respect to the bridge plate 34. The cutting belts 34, 36 in passing through the well 32, extend between the pressure shoes 82, 84, as clearly shown. For such condition, the cutting belts will have their cutting surfaces spaced apart a distance sufficient to readily admit one of the seal flanges 16, 18 of the turbine blade 10. However, when the handles 90, 92 are pulled forwardly by the operator of the machine, the pressure shoes 82, 84 will be swiveled toward each other and will engage the back, non-cutting surfaces of the belts 34, 36 in a manner to cause the cutting surfaces thereof to approach each other, all as shown in FIG. 3.

As provided by the invention, the turbine blades 10 can be mounted one at a time on a slide 94 which carries a clamp block 96 adapted to engage and position a side portion of the turbine blade 10 adjacent the outer end 14 thereof. The slide 94 also carries to toggle clamp 98 having a jaw portion 100 adapted to engage the other side portion of the turbine blade 10 so as to enable the blade to be securely, fixedly clamped to the slide. The inner end 20 of the turbine blade rests on a second clamp block 102 and is positioned against a shoulder 104 thereof. The mounting base portion 22 of the blade 10 is engaged by the clamping jaw 106 of a toggle clamp 108 which is mounted on the slide 94.

The toggle clamps 98, 108 have handles 110, 112 respectively, by which jaws are actuated to their clamping positions and locked therein. The action of the toggle clamps 98, 108 is well understood, and needs no further explanation since per se they form no part of the present invention.

Also in accordance with the invention, a guide plate 114 is secured to the top surface of the bench plate 30 by clamp screws 116 passing through slots 118 whereby the guide plate can be adjustably fixed in different positions. Cooperable adjustable stops 117 and 119 respectively on the top plate 30 and slide 94 limit the advancing or upward (as viewed in FIG. 2) movement of the slide 94 to that just necessary to bring the seal 16 between the belts 34, 36. In the appended claims, the screw 117 is referred to as a limit screw. With the arrangement illustrated in FIG. 2, the slide 94 can be shifted upward as viewed in the figure along the guide plate 114 so as to bring the seal flange 16 between the cutting surfaces of the cutting belts 34, 36 in the manner shown in FIG. 3. After this has been done, the operator grasps the handles 90, 92 and pulls them forwardly so as to bring together the pressure shoes 82, 84 against the back surfaces of the belts 34, 36 and shift the belts forcibly into engagement with the opposite side surfaces of the seal flange 16. The cutting belts thereupon remove the excess welding material from the seal flange, and effectively refinish the flange to have the characteristics needed for operation, including the required original smooth surface. In order to predetermine the exact amount of material which is removed from the seal flange during the finishing operation, left and right adjustable stop screws 120, 122 are provided on the bridge plate 34, such screws being engageable with the carrier blocks 86, 88 as shown in FIG. 3 to limit the pivoting movement thereof.

After a short interval of time, during which the cutting belts 34, 36 are removing material, the operator releases his pressure against the handles 90, 92 and shifts them rearward to the position illustrated in FIG. 2. An inspection of the refinished flange 16 will reveal whether additional material need be removed, or else if the flange is in a satisfactory, finished state.

The pressure shoes 82, 84 are provided with shouldered positioning portions 124, 126 which are adapted to engage the back edge surfaces of the cutting belts 34, 36 and maintain the alignment of such belts at the time that they are removing metal.

It will now be understood from the foregoing that I have provided a novel and improved, especially simple and effective machine for refinishing the side surfaces of air seal flanges of turbine blades which are located at the extremities of the blades and which have been resurfaced by welding or adding metal in any other suitable manner.

The refinishing operation takes place quickly, and the operator can easily remove the refinished turbine blade 10 and replace it with a new blade for continued refinishing operations all with a minimum of time and effort since the toggle clamps 98, 108 operate quickly and effortlessly while at the same time securely locking the turbine blades against the clamp blocks.

Variations and modifications are possible without departing from the spirit of the invention.

I claim:

1. A machine for refinishing the side surfaces of air seal flanges which are located at the extremities of turbine blades and which have been resurfaced by welding, comprising in combination:

a. a stationary base, b. a pressure shoe, c. means for pivotally mounting the pressure shoe on the base at a work-performing station, d. a cutting belt having a surface provided with cutting particles, e. means for driving said belt past the pressure shoe at said work-performing station, with the back of the belt facing the shoe whereby the belt can be laterally shifted by the shoe to advance the cutting surface thereof, f. handle means on the pressure shoe, for pivotally moving the latter toward and away from the cutting belt, g. a slide movable over the base toward and away from said belt at the work-performing station, h. a clamping device carried by the slide, adapted to clamp a turbine blade so as to enable the slide to present a resurfaced side area of the seal flange of the blade to the cutting surface of the belt, i. a second cutting belt similar to the first-mentioned belt, j. means for driving the second belt past said work-performing station, with the cutting surfaces of the belts facing each other in spaced relation whereby the seal flange of the turbine blade can be interposed between said surfaces, k. a second pressure shoe, l. means pivotally mounting the second pressure shoe on the base to enable it to shift the second cutting belt toward the first belt, m. handle means on the second pressure shoe for effecting pivotal movement of the latter toward and away from the second cutting belt, and n. adjustable stop means comprising abutment screws on the base, capable of having abutting engagement with the shoes for limiting the pivotal movements thereof in directions which advance the cutting surfaces of the belts toward each other.

2. A machine as in claim 1, wherein:

a. the pressure shoes have positioning shoulders engageable with edges of the cutting belts to restrict edgewise movement thereof.

3. A machine as in claim 1, wherein:

a. the pressure shoes are located at the rear of the base, b. said handle means comprising arms extending from the pressure shoes in opposite directions, c. forward movements of said arms swivelling the pressure shoes toward each other.

4. A machine as in claim 1, and further including:

a. guide means on the base, adapted for engagement by the slide to direct the latter for interposing between the belts the seal flange of a blade on the slide.

5. A machine as in claim 1, wherein:

a. the means for driving the belts comprise independent sets of pulleys for the respective belts, and independent drive motors associated respectively with the sets of belts and powering the same.

6. A machine as in claim 5, wherein:

a. those portions of each of the belts which are located at any time at the work-performing station constitute a span of appreciable length and pass over pulleys which are spaced apart an appreciable distance whereby the belts at said station can be readily displaced laterally within limits.

7. A machine as in claim 4, wherein:

a. said guide means comprises a plate having slots, bolted to the base by screws passing through said slots.

8. The invention as defined in claim 1, and further including:

a. an adjustable limit screw carried by the base, for engagement with the slide when the latter has reached a predetermined position in approaching the work performing station, to longitudinally position the turbine blade as the seal flange thereof is engaged by the belts.

* * * * *